US008854643B2

(12) United States Patent
Takayama

(10) Patent No.: US 8,854,643 B2
(45) Date of Patent: Oct. 7, 2014

(54) PRINTING TAPE ADAPTATION SYSTEM, APPARATUS, METHOD AND COMPUTER-READABLE MEDIUM

(75) Inventor: Shoji Takayama, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 134 days.

(21) Appl. No.: 13/418,526

(22) Filed: Mar. 13, 2012

(65) Prior Publication Data

US 2012/0243927 A1 Sep. 27, 2012

(30) Foreign Application Priority Data

Mar. 22, 2011 (JP) ..... 2011-062161

(51) Int. Cl.
*B41J 11/42* (2006.01)
*B41J 11/00* (2006.01)
*B41J 3/407* (2006.01)

(52) U.S. Cl.
CPC ..... *B41J 3/4075* (2013.01); *B41J 11/009* (2013.01)
USPC ..... 358/1.13; 358/1.15

(58) Field of Classification Search
USPC ..... 358/1.1, 1.9, 1.12, 1.13, 1.15, 400, 401, 358/296; 400/586, 587, 594
See application file for complete search history.

(56) References Cited

U.S. PATENT DOCUMENTS

2004/0265027 A1 12/2004 Hine et al.
2005/0007606 A1 1/2005 Miyasaka

FOREIGN PATENT DOCUMENTS

CN 1576037 A 2/2005
JP 2004-355510 12/2004
JP 2004355510 A * 12/2004
JP 2006150753 A * 6/2006

* cited by examiner

*Primary Examiner* — Thomas D Lee
(74) *Attorney, Agent, or Firm* — ALG Intellectual Property, LLC

(57) ABSTRACT

An information processing apparatus used in connection with a tape printing apparatus has a tape information acquisition section which acquires from the tape printing apparatus tape information about a tape mounted therein, a new standardized tape discrimination section which discriminates whether a new standardized tape having a standard different from an existing standard has been mounted or not based on the tape information, a printing parameter acquisition section which acquires a printing parameter corresponding to the new standardized tape in a case that it is discriminated that the new standardized tape has been mounted, and a data transmission section which transmits the printing parameter acquired by the printing parameter acquisition section to the tape printing apparatus.

8 Claims, 7 Drawing Sheets

PRINTING TAPE ADAPTATION SYSTEM, APPARATUS, METHOD AND COMPUTER-READABLE MEDIUM

The entire disclosure of Japanese Patent Application No. 2011-062161, filed on Mar. 22, 2011, is expressly incorporated by reference herein.

BACKGROUND

1. Technical Field

The present invention relates to an information processing apparatus which is connected to a tape printing apparatus and is capable of transmitting print data to the tape printing apparatus, a method of controlling thereof, a printing system, the tape printing apparatus, and a computer-readable medium.

2. Related Art

A tape printing apparatus which can incorporate various types of tapes (tape cartridges) therein and can print on a mounted tape as a user desires has been already known (for example, see JP-A-2004-355510). The tape printing apparatus has a tape discrimination sensor with which a plurality of apertures formed on a cartridge are detected, thereby, whether a tape (tape cartridge) has been mounted and a tape type (a type of the tape cartridge) can be detected.

To increase types (variations) of tapes (tape cartridges) used in the above tape printing apparatus, new standardized (type) tapes have been considered in addition to existing tapes. However, when providing the new standardized tapes, printing conditions of the tape and an ink ribbon must be designed to adapt to printing conditions or specification of the existing tape printing apparatus, or the tape printing apparatus itself must be changed to correspond to the new standardized tapes. Therefore, design limitations may occur when the new standardized tapes are provided, or it may not possible to adapt easily even if the new standardized tapes are provided.

SUMMARY

Therefore, it is an advantage of the invention to provide an information processing apparatus capable of adapting new standardized tapes easily, a method of controlling thereof, a printing system, a tape printing apparatus, and a computer-readable medium.

In one aspect of the invention, there is provided an information processing apparatus used in connection with a tape printing apparatus having: a tape information acquisition section which acquires from the tape printing apparatus tape information about a tape mounted therein; a new standardized tape discrimination section which discriminates whether a new standardized tape having a standard different from an existing standard is mounted or not based on the tape information; a printing parameter acquisition section that acquires a printing parameter corresponding to the new standardized tape in a case that it is discriminated the new standardized tape is mounted; and a data transmission section that transmits the printing parameter acquired by the printing parameter acquisition section to the tape printing apparatus.

In another aspect of the invention, there is provided a method of controlling an information processing apparatus used in connection with a tape printing apparatus executing steps of: acquiring from the tape printing apparatus tape information about a tape mounted therein; discriminating whether a new standardized tape having a standard different from an existing standard is mounted or not based on the tape information; acquiring a printing parameter corresponding to the new standardized tape in a case that it is discriminated the new standardized tape is mounted; and transmitting the printing parameter acquired by the printing parameter acquisition step to the tape printing apparatus.

With these configurations, in a case that a new standardized tape (tape (tape cartridge) designed based on a new standard) has been mounted in a tape printing apparatus is discriminated (detected), a printing parameter (parameter for print control) corresponding to the new standardized tape is acquired. Then, the acquired printing parameter can be transmitted to the tape printing apparatus. In other words, since the tape printing apparatus only has to execute printing based on the received printing parameter from the information processing apparatus, it is easily possible to optimally print on the new standardized tape without modifying the tape printing apparatus itself when the new standardized tape is used. In preparing (designing) the new standardized tape, it is possible to provide tapes with variations to a user because there is no need to adapt to the existing standard (specification).

It is preferable that, in the information processing apparatus of the invention, the printing parameter include at least one of print speed of the tape printing apparatus, a number of divisional prints by a print head of the tape printing apparatus in printing, applied time of the print head in the printing and position information of a heater element formed in the print head used in the printing.

With this configuration, since various printing parameters can be set when the new standardized tape is prepared, it is possible to handle tapes and ink ribbons having various tape width and material, thereby, tape variations can be more increased. The number of divisional prints by the print head in the printing indicates the number of division of activation timing when a plurality of heater elements formed in the print head are divided into a plurality of groups, a plurality of activation timings are set by dividing one activation frequency of the print head, and each group of the heater elements is assigned to one of the plurality of activation timings for printing (in short, each group of the heater elements is activated in time division).

It is preferable that, in the information processing apparatus, a report section be provided which reports that the printing parameter corresponding to the new standardized tape is needed in a case that it is discriminated that the new standardized tape is mounted by the new standardized tape discrimination section.

With this configuration, when the new standardized tape is mounted in the tape printing apparatus, that the printing parameter is needed is reported (informed) to the user. Since the report can prompt the user to acquire the printing parameter, it is possible for the user to remind that the printing parameter corresponding to the new standardized tape should be acquired. The report (informing) method may be displaying a message describing that the printing parameter is needed on a screen, informing by sound (reading the message or beep sound), or notifying with both of them.

It is preferable that, in the information processing apparatus, the tape information include at least one of tape width, tape material of the tape and information about ink printed on the tape.

With this configuration, it is possible to discriminate whether the new standardized tape is mounted or not based on various items (the tape width, the tape material, the information about the ink (the ink ribbon) printed on the tape, and the like).

In another aspect of the invention, there is provided the printing system having the information processing apparatus and the tape printing apparatus capable of being connected with the information processing apparatus as described above, the tape printing apparatus having a data reception section which receives print data and the printing parameter from the information processing apparatus and a print controller which controls to print the print data based on the received printing parameter.

In another aspect of the invention, there is provided a tape printing apparatus of the invention used in the printing system described above.

In the other aspect of the invention, there is provided a computer-readable medium which causes a computer to function as each section of the information processing apparatus descried above.

By using these configurations, when the new standardized tape is mounted in the tape printing apparatus, it is possible to acquire the printing parameter corresponding to the new standardized tape and to print thereon optimally based on the acquired printing parameter.

DESCRIPTION OF EXEMPLARY EMBODIMENTS

An information processing apparatus, a method of controlling thereof, a printing system, a tape printing apparatus, and a computer-readable medium of the invention will be described with reference to the accompanying drawings. In the embodiment, the printing system having the information processing apparatus and the tape printing apparatus will be exemplified.

Figure 1:
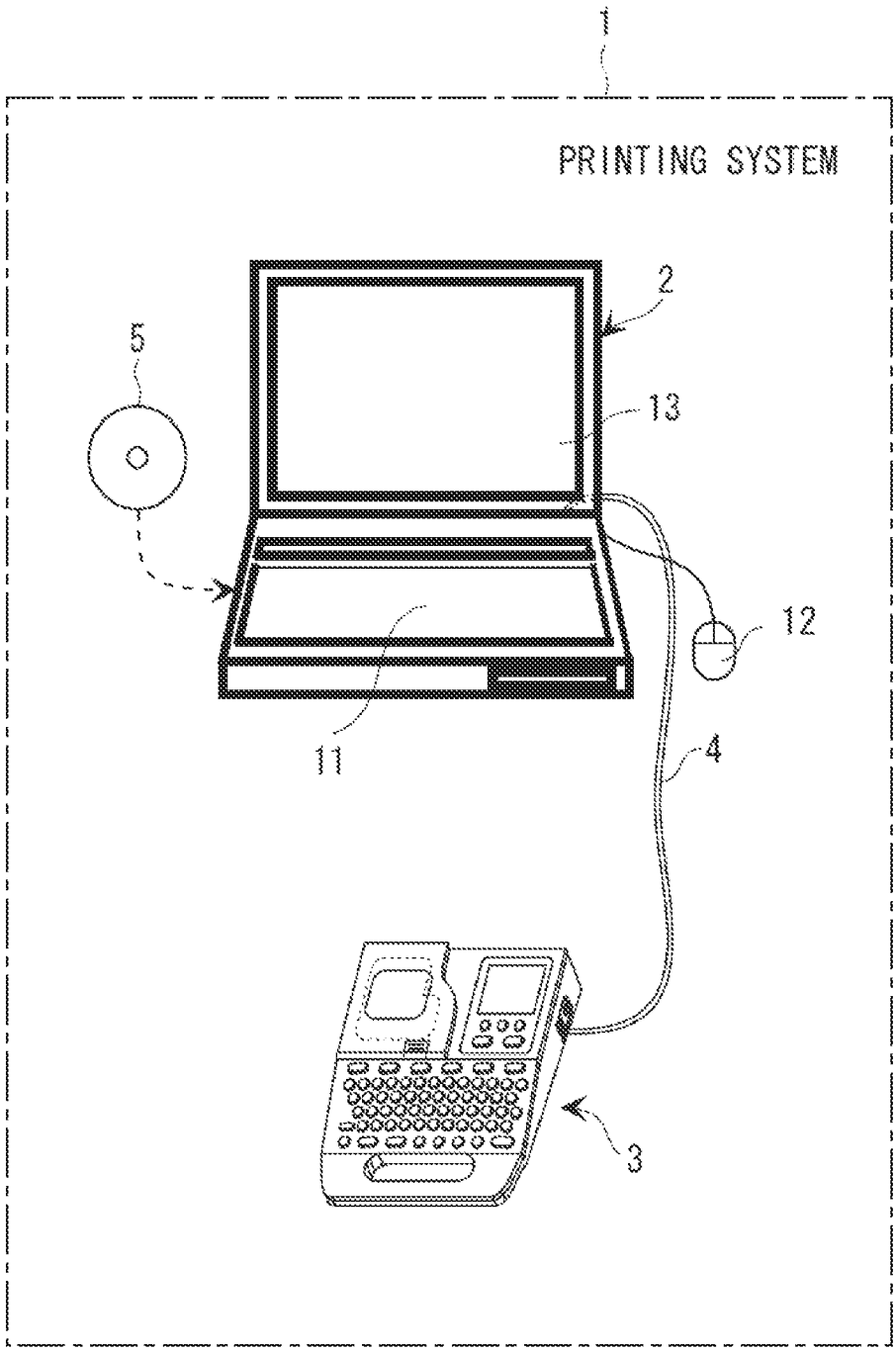
FIG. 1 is a schematic diagram of a printing system according to one embodiment of the invention.

FIG. 1 is a schematic diagram of a printing system 1. As illustrated in FIG. 1, the printing system 1 includes an information processing apparatus 2 and a tape printing apparatus 3, both of which are mutually connected via a cable 4. A general personal computer having a keyboard 11, a mouse 12, a display 13 and the like is available for the information processing apparatus 2. In other words, the personal computer can be caused to function as the information processing apparatus 2 of the embodiment by installing a PC application 20*b* and a printer driver 20*c* (see FIG. 2) stored in an optical disk 5 such as a CD-ROM or a DVD-ROM.

The tape printing apparatus 3 uses an elongated tape T (see FIG. 4) as printing medium and prepares a label by printing on and cutting the tape T based on print (image) data and printing parameters (details thereof are described later) acquired from the information processing apparatus 2.

In the embodiment, the configuration in which the information processing apparatus 2 and the tape printing apparatus 3 are directly connected to each other via the cable 4 is exemplified, however, they may be connected via a network (the Internet or a local area network), or otherwise through a wireless communication.

Figure 2:
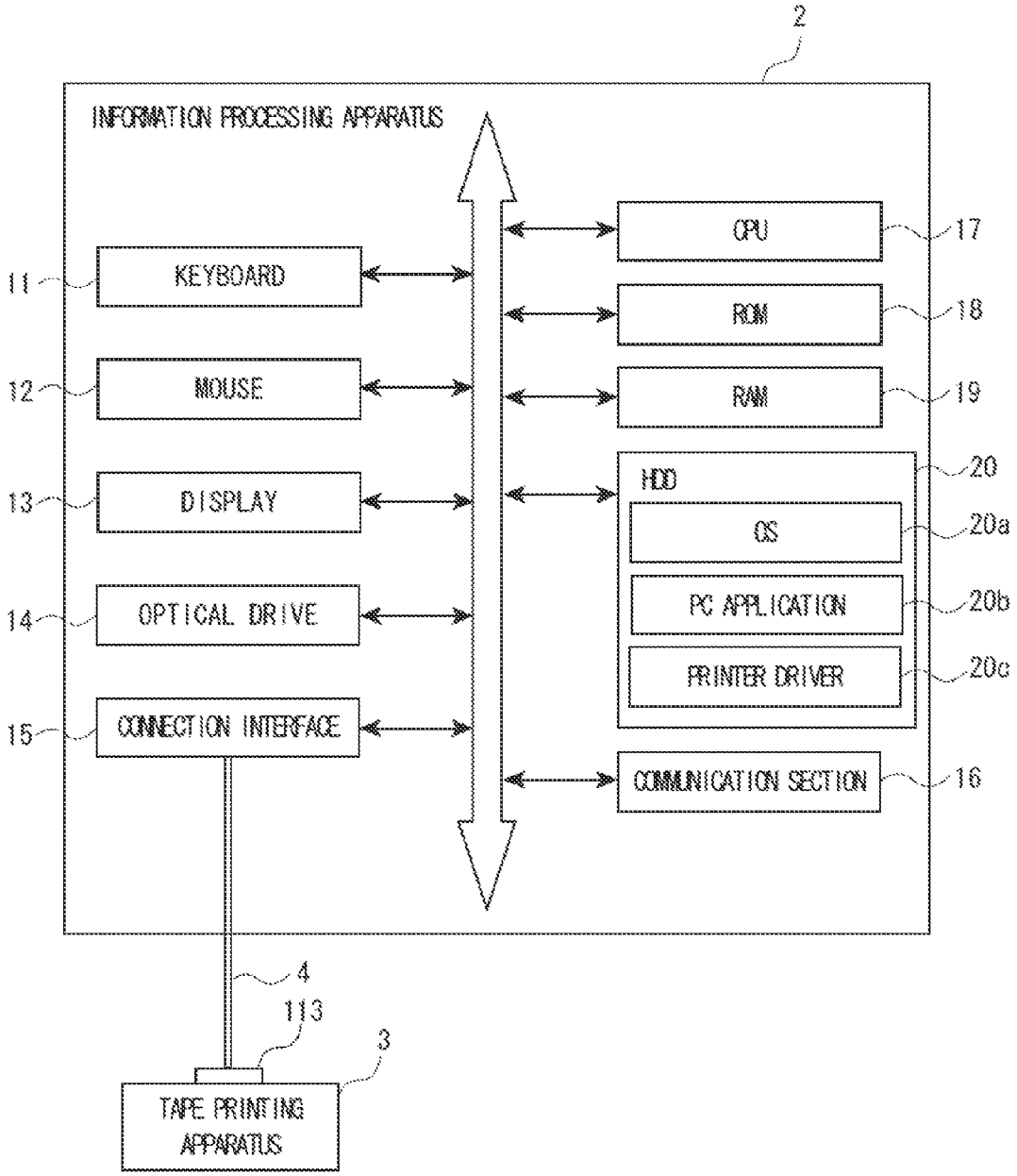
FIG. 2 is a control block diagram of an information processing apparatus.

Referring to FIG. 2, a control structure of the information processing apparatus 2 will be described. The information processing apparatus 2 includes an optical drive 14, a connection interface 15, a communication section 16, a CPU (Central Processing Unit) 17, a ROM (Read Only Memory) 18, a RAM (Random Access Memory) 19, and a hard disk (HDD: Hard Dick Drive) 20, in addition to the keyboard 11, the mouse 12 and the display 13 as illustrated in FIG. 1.

The optical drive 14 reads data stored in the CD-ROM 5, and is used, in the embodiment, for installing the PC application 20*b* and the printer driver 20*c*. The optical disk 5 is supplied to a user as an accessory of the tape printing apparatus 3. The connection interface 15 is a connection port for connecting to a connector 113 of the tape printing apparatus 3 via the cable and uses a USB interface therefor in the embodiment. The communication section 16 is used as an interface for accessing to an external server ((not shown) a server provided by a manufacturer of the tape printing apparatus 3 and/or tape T) via the network (the Internet). The external server is used to provide various types of information relating to the tape printing apparatus 3, various tapes T, the PC application 20*b*, and the like to the user.

The CPU 17 controls the entire information processing apparatus 2 by computing various kinds of data. The ROM. 18 stores a control program and control data with which the CPU 17 executes various processes. The RAM 19 is used as work area when the CPU 17 executes various processes.

The hard disk 20 stores an operating system (OS) 20*a*, as well as the PC application 20*b* and the printer driver 20*c* which are read from the optical disk 5. The printer driver 20*c* interfaces between the operating system 20*a* and the tape printing apparatus 3.

The PC application 20*b* is application software incorporated in the operating system. 20*a* to be used, and executes processes such as forming/editing of a print image G (see FIG. 3) which is printed by the tape printing apparatus 3, adjusting tape width/length, a print instruction and the like. The PC application 20*b* acquires information (tape information) about a tape T (tape cartridge C (see FIG. 4)) mounted in the tape printing apparatus 3 when the print instruction is given, and discriminates whether the mounted tape T is a new standardized tape or not based on the acquired tape information (details thereof will be explained later). In a case that the tape T is discriminated as the new standardized tape, printing parameters corresponding to the new standardized tape are acquired and are transmitted with the print data to the tape printing apparatus 3.

The above-mentioned new standardized tape is the tape T designed based on a new standard (for example, the tape T made from a new material, having the new tape width or the like), and includes the tape T on which optimal (normal) printing can not be executed by the existing tape printing apparatus 3, that is, the tape T which is not supported by the existing tape printing apparatus 3. While, the tape T on which optimal (normal) printing can be executed by the existing tape printing apparatus 3, that is, the tape T which is supported by the existing tape printing apparatus 3 is called as an existing tape.

The printing parameters are used to control a drive section 136 (see FIG. 5) of the tape printing apparatus 3 in a print process, and includes information about print speed, the number of divisional prints by a print head 116 (see FIG. 4), applied time of the print head 116 and positions of heater elements formed on the print head 116 when used in printing. In short, the printing parameters corresponding to the above new standardized tape are parameters to control the drive section 136, thereby optimal printing can be executed on the new standardized tape by the existing tape printing apparatus 3. The printing parameters corresponding to the existing tape is, not to mention, pre-stored in the tape printing apparatus 3.

Figure 3:
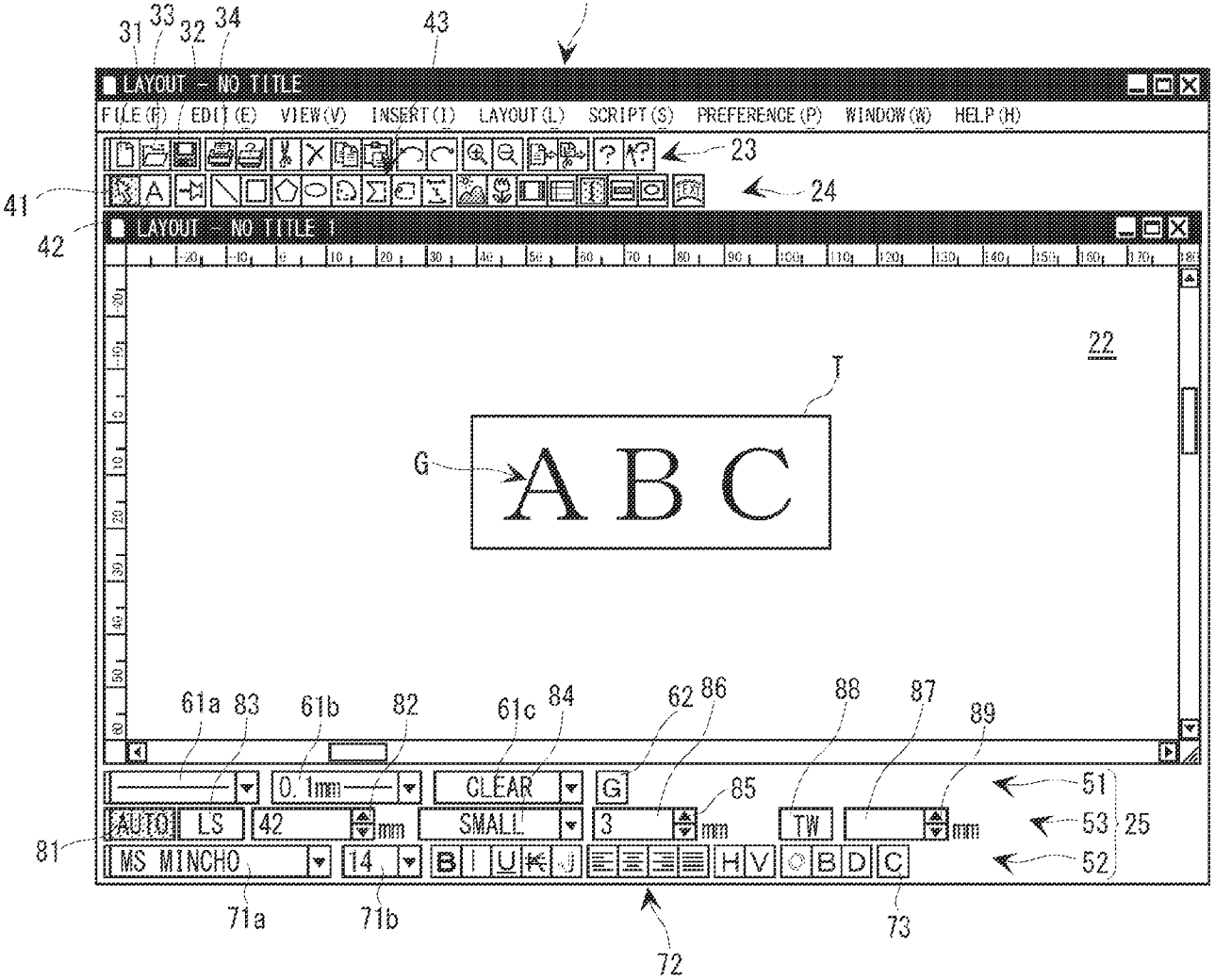
FIG. 3 is a schematic diagram of an edit screen displayed by activating a PC application.

Referring to FIG. 3, an edit screen 21 (application window) displayed on the display 13 by activating the PC application 20*b* will be described. The edit screen 21 includes an edit area 22 on which an image of the tape T (called as "tape T" hereinafter) and the print image G are applied, a basic operation toolbar 23 used for basic operations, an input toolbar 24 with which characters and graphics are input as input data, and an edit toolbar 25 with which the input data is edited.

The basic operation toolbar 23 includes a new creation button 31 used for newly creating the print data (print image G), a save button 32 used for saving the created print data, a read button 33 used for reading out the saved image data to display on the edit area 22, a print button 34 used for printing based on an edit result displayed on the edit area 22, and the like. The PC application 20*b* of the embodiment displays, when the print button 34 is pressed by the user, a print preview screen (not shown) and starts to actually print when a predetermined button (such as a print start button) on the print preview screen is pressed.

The input toolbar 24 includes an object selection button 41 used for selecting an object such as the tape T or the print image G, a character input button 42 used for inputting characters, and various graphical input buttons 43 used for inputting straight lines and graphics, and the like.

The edit toolbar 25 is composed of a graphical toolbar 51 used for editing input graphics, a character toolbar 52 used for editing input characters and a label creation toolbar 53 used for creating a label by the tape printing apparatus 3.

The graphical toolbar 51 has three list boxes 61*a*, 61*b* and 61*c* (pull-down menus) each of which is used for selecting and setting a type, thickness, and filling of outline of graphics from a plurality of options, and a graphical setting window display button 62 used for displaying a window to perform various settings for graphics.

The character toolbar 52 includes list boxes 71*a* and 71*b* (pull-down menus) each of which is used for selecting and setting a font and a size of the input character, various (fourteen) setting buttons 72 used for performing settings for a style (bold, italic, underlined, etc.) of the input characters, a layout (e.g. centering, right-alignment), horizontal or vertical, and character decoration (outline and border), and a character setting window display button 73 used for displaying a window to perform various settings for the input characters.

The label creation toolbar 53 includes an automatic setting button 81 used for automatically setting the length of the tape T to be created depending on the shape or size of the print image G, a length setting button 83 used for setting the length of the tape T to be created to a predetermined length selected by a scroll bar 82, a margin setting list box 84 used for selecting and setting the length of a margin added in front of the print image G from short, medium, and long, a margin setting box 86 used for setting the length of the margin in numeric value by a scroll bar 85 same as the above, and a tape-width acquisition button 88 used for acquiring the tape width of the tape T mounted in the tape printing apparatus 3 (through a communication with the tape printing apparatus 3) and for displaying the tape width in a tape-width display box 87. The tape-width display box 87 incorporates a scroll bar 89, and the tape width may be set manually.

Figure 4:
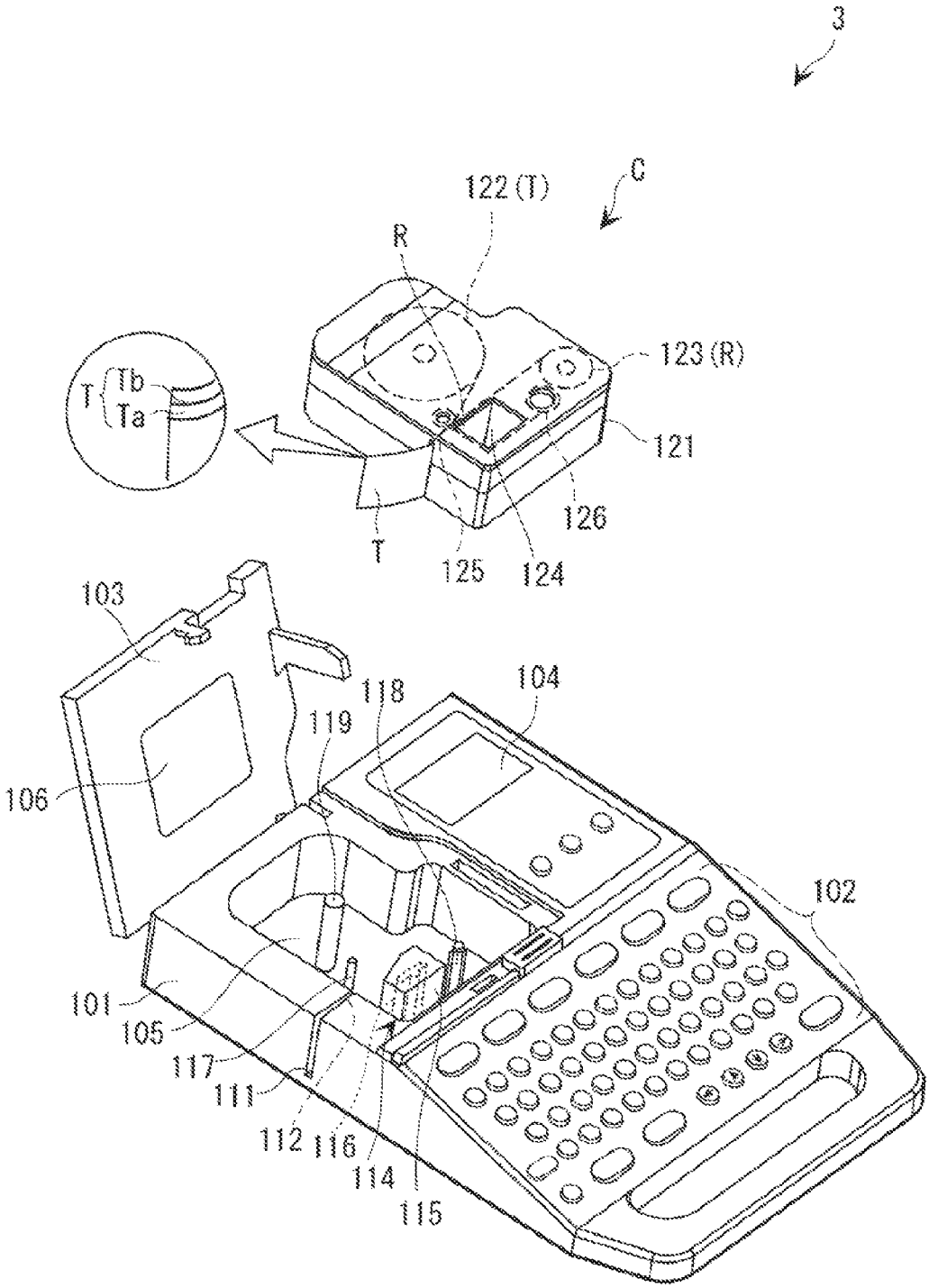
FIG. 4 is an external perspective view of a tape printing apparatus of which an opening/closing lid is opened.

Referring to FIG. 4, a structure of the tape printing apparatus 3 will be described. FIG. 4 is an external perspective view of the tape printing apparatus 3 of which an opening/closing lid 103 is opened. As illustrated in FIG. 4, the tape printing apparatus 3 is formed with a casing 101 as an outer shell, and a keyboard 102 having various input keys is disposed on the front surface of the casing 101. The opening/closing lid 103 is provided on the top left of the back of the casing 101, and a display screen 104 which displays an input result etc. from the keyboard 102 is provided on the top right of the back of the casing 101.

At the inside of the opening/closing lid 103, a cartridge mounting section 105 used for mounting the tape cartridge C is recessed and formed, and the tape cartridge C is detachably mounted in the cartridge mounting section 105, with a state that the opening/closing lid 103 is opened. An observation window 106 is formed for viewing whether the tape cartridge C is mounted/demounted with a state that the opening/closing lid 103 is closed.

A tape ejecting slot 111 communicating between the cartridge mounting section 105 and the outside is formed on the left side of the casing 101, and a tape cutter 112 for cutting off the fed tape T is disposed so as to face the tape ejecting slot 111. The printed tape T is fed from the tape ejecting slot 111 by predetermined length, and the tape cutter 112 cuts off the printed tape to create a strip-shaped label in a state that the tape T is temporally stopped.

Although not illustrated, a power supply port for supplying power and the connector 113 (see FIG. 2) for connecting with the information processing apparatus 2 are provided on the right side of the casing 101. A circuit board which constitutes a control section 137 (see FIG. 5) to collectively control the tape printing apparatus 3 is incorporated in the casing 101.

The cartridge mounting section 105 has a head unit 114 in which a thermal type print head 116 with a plurality of heater elements is provided in a head cover 115, a platen drive shaft 117 facing against the print head 116, a take-up drive shaft 118 which takes up an ink ribbon R described later, and a positioning boss 119 for a tape reel 122 described later. Further, a tape feeding motor 142 (see FIG. 5) which rotates the platen drive shaft 117 and the take-up drive shaft 118 is embedded at the bottom side of the cartridge mounting section 105.

The tape cartridge C accommodates a tape reel 122 which winds the tape T on the upper center in a cartridge case 121 and a ribbon reel 123 which winds the ink ribbon R at the lower right side therein, the tape T and the ink ribbon R having the same width. Further, at the lower left side of the tape reel 122, a through aperture 124 is formed in which the head cover 115 covering the head unit 114 is inserted. Still further, a platen roller 125 which fits into the platen drive shaft 117 to be rotatably driven is so placed as to correspond to a portion where the tape T and the ink ribbon R overlap at the head unit 114 inserted in the through aperture 124. A ribbon take-up reel 126 is disposed in proximity to the ribbon reel 123. The ink ribbon R fed from the ribbon reel 123 goes around the head cover 115 and is wound up by the ribbon take-up reel 126.

When the tape cartridge C is mounted in the cartridge mounting section 105, the head cover 115, the positioning boss 119 and the take-up drive shaft 118 are inserted in the through aperture 124, in the center aperture of the tape reel 122, and in the center aperture of the ribbon take-up reel 126, respectively. The tape T and the ink ribbon Rare sandwiched when the print head 116 abuts on the platen roller 125, thereby printing is available. The tape T is fed from the tape cartridge C by the tape feeding motor 142 based on the print data transmitted from the information processing apparatus 2, and desired printing is executed on the tape T by heating the heater elements of the print head 116 selectively. A printed portion of the tape T is fed to the outside through the tape ejecting slot 111 as needed. After completing printing, the tape feeding motor 142 feeds the tape T to a position corresponding to a tape length including a margin and stops the feeding (then, a cutting process is performed).

The tape T is composed of a recording tape Ta in which an adhesive agent layer is applied on the back surface and a peeling tape Tb adhered to the recording tape Ta by the adhesive agent layer. The tape T is wound into roll in which the recording tape Ta and the peeling tape Tb faces outside and inside, respectively, to be housed in the cartridge case 121. A plurality of tapes having different tape types (tape width, tape color, base pattern, material (texture) etc.) are prepared. Each cartridge case 121 houses one type of the tape T and the ink ribbon R.

On the back surface of the cartridge case 121, a plurality of small holes (not shown) are formed, by which a type of the tape cartridge C is specified. Also, a plurality of tape discrimination sensors 144 (e.g. micro switches) (see FIG. 5) to detect the holes are provided on the cartridge mounting section 105 to correspond to the holes. By detecting states of the plurality of holes by the tape discrimination sensors 144, it is possible to discriminate the tape type.

Figure 5:
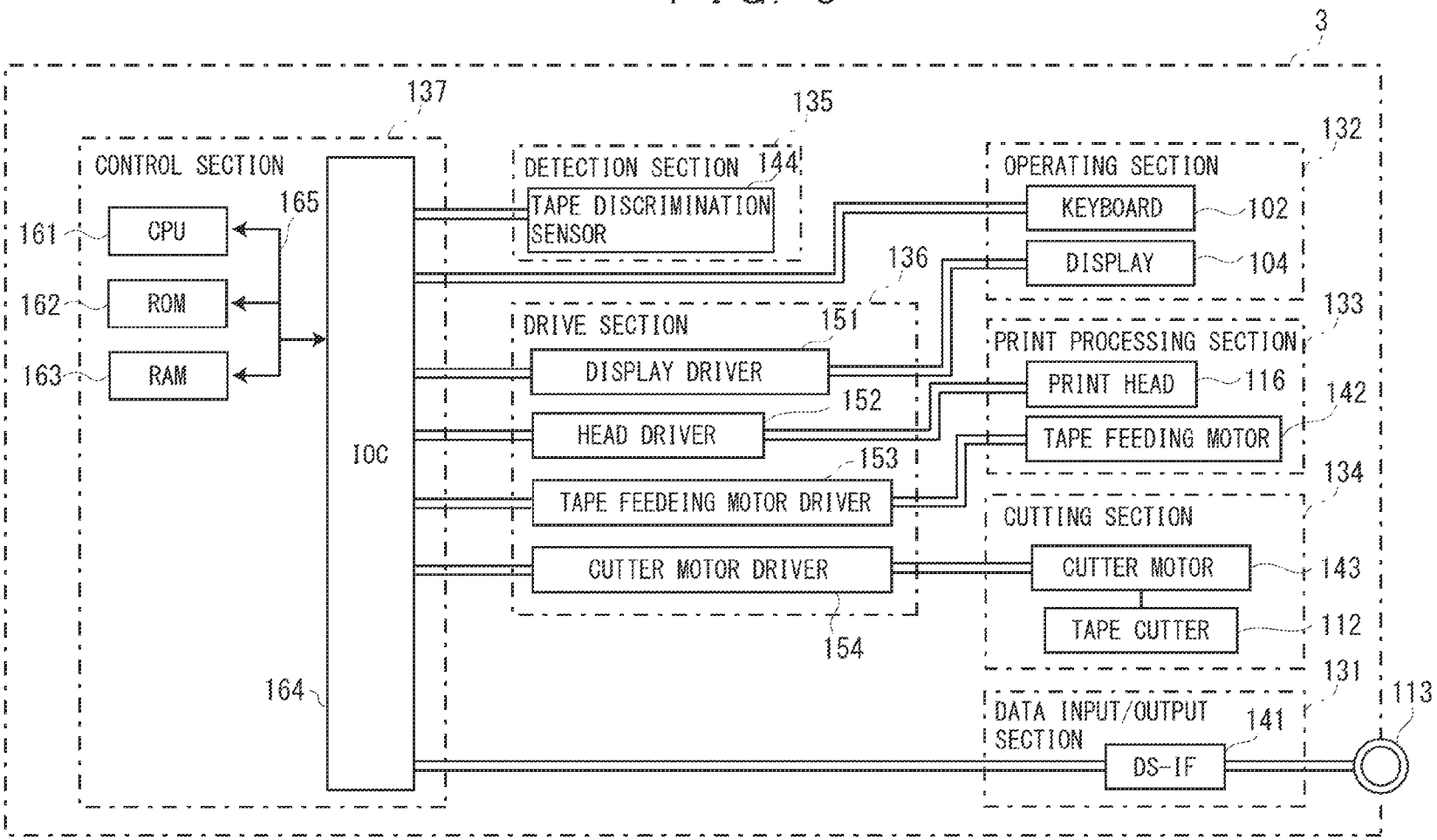
FIG. 5 is a control block diagram of the tape printing apparatus.

Referring to FIG. 5, a control structure of the tape printing apparatus 3 will be described. The tape printing apparatus 3 is configured with a data input/output section 131, an operating section 132, a print processing section 133, a cutting section 134, a detection section 135, a drive section 136, and the control section 137 which connects to respective sections and controls the entire tape printing apparatus 3.

The data input/output section 131 has a data supply interface (DS-IF) 141, and inputs the print (image) data from the information processing apparatus 2 via the connector 113 while inputting/outputting various commands and statuses. The operating section 132 has the keyboard 102 and the display 104 (liquid crystal display), and serves as a user interface such as inputting character information and displaying various pieces of information by the user.

The print processing section 133 has the print head 116 and the tape feeding motor 142, and prints the character information and the image data input or received on the tape T while feeding the tape T and the ink ribbon R. The cutting section 134 has the tape cutter 112 and a cutter motor 143 which drives them, and cuts the printed tape T.

The detection section 135 has sensors such as a rotational speed sensor (not shown) which detects a rotational speed of the tape feeding motor 142 in addition to the tape discrimination sensors 144, and performs various detections. The drive section 136 has a display driver 151, a head driver 152, a tape feeding motor driver 153 and a cutter motor driver 154, and drives respective sections.

The control section 137 includes a CPU 161, a ROM 162, a RAM 163 and an input/output controller (IOC) 164, and all of which are interconnected via an internal bus 165. The CPU 161 receives various signals/data from respective sections of the tape printing apparatus 3 via the IOC 164 based on the control program and the control data (including the printing parameters) in the ROM 162. Also, printing process and the like are controlled by processing various data in the RAM 163 based on the input various signals/data and outputting the various signal data to each section in the tape printing apparatus 3.

For example, when the print (image) data is acquired from the information processing apparatus 2 via the data supply interface 141, the CPU 161 sends instructions for activating the print head 116 and the tape feed motor 142 to the drive section 136 to perform printing based on the printing parameters stored in the ROM 162. Further, when the printing parameters are acquired together with the print data from the information processing apparatus 2, the CPU 161 sends activation instructions to the drive section 136 based on the acquired printing parameters. In other words, the activation instructions are sent using the acquired printing parameters in place of pre-stored printing parameters.

Figure 6:
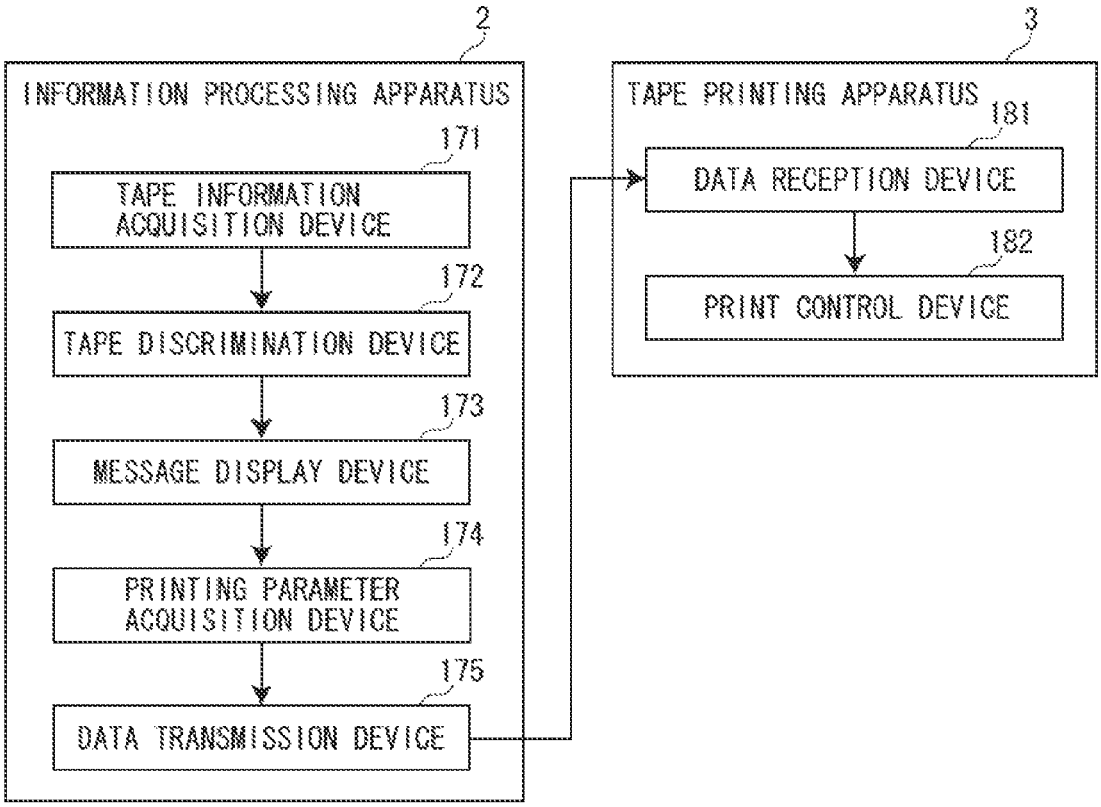
FIG. 6 is a functional block diagram of the information processing apparatus and the tape printing apparatus.

Referring to a block diagram illustrated in FIG. 6, functional structures of the information processing apparatus 2 and the tape printing apparatus 3 will be explained. Both the functions when the printing process is executed will be explained. The information processing apparatus 2 has a tape information acquisition device 171 (tape information acquisition section), a tape discrimination device 172 (new standardized tape discrimination section), a message display device 173 (report section), a printing parameter acquisition device 174 (printing parameter acquisition section), and a data transmission device 175 (data transmission section). Each device is mainly formed by the CPU 17 and the PC application 20*b*.

The tape information acquisition device 171 acquires from the tape printing apparatus 3 tape information (tape width, tape material and information (ink information) and the like about the ink ribbon R about the tape T (tape cartridge C) mounted in the tape printing apparatus 3 by giving an acquisition request (tape information acquisition request) for the tape information to the tape printing apparatus 3.

The tape discrimination device 172 discriminates whether the tape T mounted in the tape printing apparatus 3 is the existing tape or the new standardized tape based on the tape information acquired by the tape information acquisition device 171. Tape information (existing tape information) about the existing tape is pre-stored in the hard disk 20 of the information processing apparatus 2 (installed simultaneously in installation of the PC application 20*b*), and the mounted tape T is discriminated as the existing tape or the new standardized tape by comparing the existing tape information with the acquired tape information.

When the new standardized tape is discriminated by the tape discrimination device 172 as having been mounted in the tape printing apparatus 3, the message display device 173 displays a message on the display 13 that printing parameters corresponding to the new standardized tape are needed and the way of acquiring the printing parameters. As displaying the way of acquisition, for example, an acquisition operation procedure such as "select [Help (H)]-[Download (not shown)]" and the like on the edit screen 21 illustrated in FIG. 3 may be employed, or URL and the like of a download source for the printing parameters may be displayed. Further, a button for downloading the printing parameters may be provided on the message screen and an operation instruction to press the button may be displayed.

The printing parameter acquisition device 174 acquires the printing parameters corresponding to the new standardized tape and stores it on a predetermined area of the hard disk 20 as data to be used in the PC application 20*b*. The printing parameter acquisition device 174 downloads the printing parameters corresponding to the new standardized tape by accessing an external server, triggered by a user's operation based on the way of acquisition on the message screen. The acquisition of the printing parameters is only executed when the tape discrimination device 172 discriminates that the tape T mounted in the tape printing apparatus 3 is a new standardized tape for the first time. In a case that the new standardized tape already discriminated has been mounted is discriminated again, the printing parameters already stored on the hard disk 20 are acquired (read out).

The data transmission device 175 transmits the print data and the printing parameters to the tape printing apparatus 3. In a case that the existing tape has been mounted in the tape printing apparatus 3 is discriminated by the tape discrimination device 172, only the print data to be an object is transmitted. On the other hand, in a case that the new standardized tape has been mounted is discriminated, the print data to be an object and the acquired printing parameters acquired by the printing parameter acquisition device 174 are transmitted.

The tape printing apparatus 3 has a data reception device (data reception section) 181 and a print control device (print controller) 182. The data reception device 181 is mainly formed by the control section 137 and the data input/output section 131 and receives the print data, or, the print data and the printing parameters from the information processing apparatus 2. The print control device 182 is mainly formed by the control section 137, the drive section 136 and the printing process section 133, and when the printing parameters in addition to the print data is received from the data reception device 181, the print data is printed based on the printing parameters. In other words, printing is performed by activating the print head 116 and the tape feeding motor 142 based on the print speed, the number of divisional prints, applied time and position information of the heater elements to be used and the like included in the received printing parameters (printing parameters corresponding to the new standardized tape) transmitted from the information processing apparatus 2. When only the print data is received, printing is performed by activating the print head 116 and the tape feeding motor 142 based on the printing parameters (printing parameters corresponding to the existing tape) stored in the ROM 162.

Figure 7:
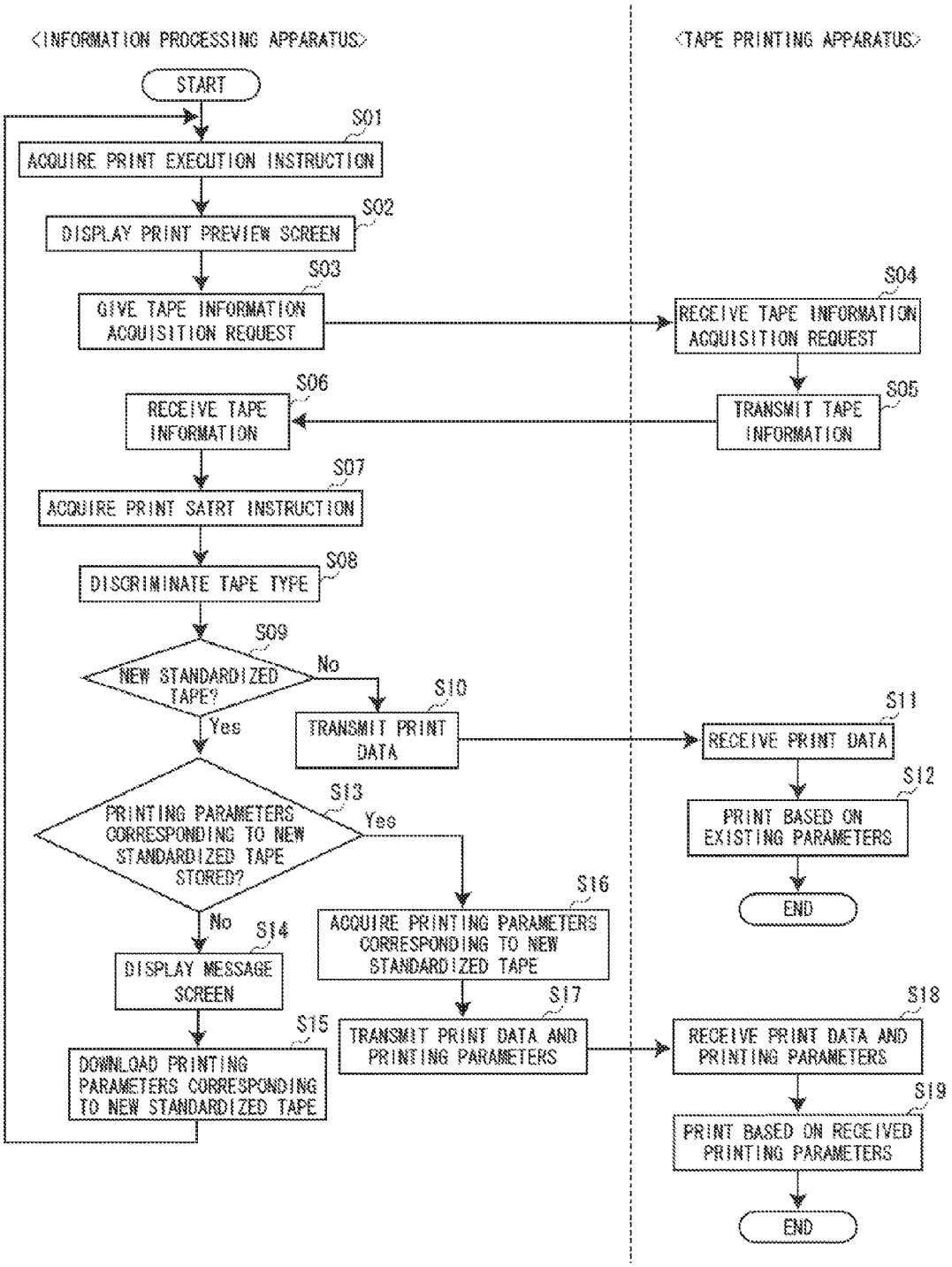
FIG. 7 is a flowchart of printing processing procedure in the printing system.

Referring to a flowchart illustrated in FIG. 7, a printing process procedure of the printing system 1 will be explained. A situation is such that the PC application 20*b* has been activated by the user and the print image G (image data) to be a printed object has been already prepared by the PC application 20*b*.

When the print button 34 is pressed on the edit screen 21 by the user, the information processing apparatus 2 (CPU 17) acquires a print execution instruction triggered by that the print button 34 has been pressed (S01) and displays a print preview screen (S02). The information processing apparatus 2 gives to the tape printing apparatus 3 a tape information acquisition request used for acquiring tape information of the tape T mounted in the tape printing apparatus 3 triggered by the display of the print preview screen (S03).

Then, when the tape information acquisition request is received (S04), the tape printing apparatus 3 (CPU 161) detects the tape information of the tape T mounted therein by the tape discrimination sensors 144 to transmit the detected tape information to the information processing apparatus 2 (S05) and the information processing apparatus 2 receives it (S06). The phrase of "acquiring tape information" in claims expresses the processes of S03 and S06 in the flowchart.

Then, the print start button is pressed on the print preview screen by the user, the information processing apparatus 2 acquires a print start instruction (S07) and triggered by the acquisition, discriminates whether the tape T mounted in the tape printing apparatus 3 is the new standardized tape or not (S08: discriminating the new standardized tape). In other words, the tape information acquired in S06 and the existing tape information pre-stored is compared and, if there is corresponding information, the tape T mounted in the tape printing apparatus 3 is discriminated as the existing tape, whereas, if there is no corresponding information, the tape T is discriminated as the new standardized tape.

In a case that the tape T mounted in the tape printing apparatus 3 is discriminated as the existing tape (S09; No), the information processing apparatus 2 creates print data from the print image G (image data) to be a printed object and transmits the print data to the tape printing apparatus 3 (S10). When the tape printing apparatus 3 receives the print data from the information processing apparatus 2 (S11), the print head 116 and the tape feeding motor 142 are driven based on the pre-stored printing parameters corresponding to the existing tape to print the print data (S12).

On the other hand, in a case that the tape T mounted in the tape printing apparatus 3 is discriminated as the new standardized tape (S09; Yes), the information processing apparatus 2 discriminates whether printing parameters corresponding to the new standardized tape are stored or not on the hard disk 20 therein. In a case that the printing parameters corresponding to the new standardized tape are not stored, that is, in S08, in a case that the mounted tape T is discriminated as the new standardized tape for the first time (S13; No), the information processing apparatus 2 displays a message showing that the printing parameters corresponding to the new standardized tape is necessary on the display 13 (S14). Then, the information processing apparatus 2 downloads the printing parameters corresponding to the new standardized tape from the external server triggered by the user's operation and stores them on the hard disk 20 (S15, acquiring printing parameters). After downloading the printing parameters, the information processing apparatus 2 displays the edit screen 21 again and stays in a state of waiting for the print execution instruction by the user (S01).

In a case that the printing parameters corresponding to the new standardized tape have been stored, that is, in S15, in a case that the printing parameters corresponding to the new standardized tape mounted in the tape printing apparatus 3 has been already downloaded (S13; Yes), the information processing apparatus 2 acquires the printing parameters corresponding to the new standardized tape from the hard disk 20 (S16, acquiring printing parameters) and transmits the printing parameters together with the print data created based on the print image G to be a printed object to the tape printing apparatus 3 (S17, transmitting data). When the tape printing apparatus 3 receives the print data and the printing parameters from the information processing apparatus 2 (S18), the print head 116 and the tape feeding motor 142 are driven based on the received printing parameters corresponding to the new standardized tape to print the print data (S19).

As explained above, according to the embodiment, when discriminating (detecting) that the new standardized tape (tape T (tape cartridge C) designed based on a new standard) has been mounted in the tape printing apparatus 3, the information processing apparatus 2 acquires the printing parameters (parameters for print control) corresponding to the new standardized tape. The acquired printing parameters are transmitted to the tape printing apparatus 3 per print data transmission. In other words, since the tape printing apparatus 3 only needs to execute printing based on the printing parameters transmitted from the information processing apparatus 2, it is easily possible to print on the new standardized tape optimally without modifying the tape printing apparatus 3 itself even if the new standardized tape is used. Further, on an occasion of preparing (designing) the new standardized tapes, it is possible to provide the tapes T having variations to the user because there is no need to adapt to the existing standard (specification).

In the embodiment, an acquisition timing of the tape information is set at the time of displaying the print preview screen, but it is not limited thereto. For example, it may be the timing when the print start instruction is acquired (after S07 in FIG. 7), or the tape information may be acquired at the timing when the PC application 20*b* is activated (at the timing of activation process for the PC application 20*b*.

As to the downloading of the printing parameters in the embodiment, in a case that the PC application 20*b* needs to be once terminated, it is possible to warn the user to save the prepared print image G (image data) before downloading and to start the downloading at the time of completion of the saving.

Further, in the embodiment, though the printing parameters are transmitted to the tape printing apparatus 3 per print data transmission, it is not limited thereto. For example, when the tape T mounted in the tape printing apparatus 3 is discriminated as the new standardized tape or when the information processing apparatus 2 is connected to the tape printing apparatus 3, the printing parameter of the new standardized tape may be transmitted.

Still further, in the embodiment, only the printing parameters corresponding to the new standardized tape are downloaded, but it is not limited thereto. For example, the PC application 20*b* itself may be updated (downloaded) so as to correspond to the new standardized tape.

Still further, in the embodiment, the print speed, the number of divisional prints by the print head 116, the applied time of the print head 116 and the positions of the heater elements formed in the print head 116 when used in printing are exemplified as printing parameters, but they are one example only and parameters for other print controls may be included.

The type of the tape mounted in the tape printing apparatus 3 may be detected by any device. For example, the detection may be executed with an IC tag or a code image (bar code, two dimensional code, and the like). In this case, the IC tag is embedded in (or a code image is adhered on) each tape T and a tape type can be detected by reading it.

Also, it may be possible to provide the PC application 20*b* described above embodiment as a program. Further, it may be possible to provide the program stored in various recording media (a CD-ROM, a flash ROM, a memory card (a compact flash (trade mark), a smart media, a memory stick, etc), a compact disk, an optical-magnetic disk, a digital versatile disk, a flexible disk, and the like. In other words, the claimed invention includes the PC application 20*b* itself and a recording medium having it recorded thereon.

Besides the embodiment above, as to the structure and each process step of the printing system 1, and the structures an each process step of the information processing apparatus 2 and the tape printing apparatus 3, it may be possible to modify the invention appropriately without departing from the scope thereof.

What is claimed is:

1. An information processing apparatus used in connection with a tape printing apparatus comprising:

a tape information acquisition section configured to acquire from the tape printing apparatus tape information about a tape mounted therein;

a new standardized tape discrimination section configured to discriminate whether a new standardized tape having a standard different from an existing standard is mounted or not based on the tape information;

a printing parameter acquisition section configured to acquire a printing parameter corresponding to the new standardized tape in a case that it is discriminated that the new standardized tape is mounted; and a data transmission section configured to transmit the printing parameter acquired by the printing parameter acquisition section to the tape printing apparatus, wherein the printing parameter includes at least one of print speed of the tape printing apparatus, a number of divisional prints by a print head of the tape printing apparatus in printing, applied time of the print head in the printing, and position information of a heater element formed in the print head used in the printing.

2. The information processing apparatus according to claim 1 further comprising a report section configured to report that the printing parameter corresponding to the new standardized tape is needed in a case that it is discriminated that the new standardized tape is mounted by the new standardized tape discrimination section.

3. The information processing apparatus according to claim 1, wherein the tape information includes at least one of tape width, tape material of the tape and information about ink printed on the tape.

4. A printing system comprising the information processing apparatus as set forth in claim 1 and a tape printing apparatus capable of being connected with the information processing apparatus, the tape printing apparatus having:

a data reception section configured to receive print data and the printing parameter from the information processing apparatus; and a print controller configured to control to print the print data based on the received printing parameter.

5. A non-transitory computer-readable medium that causes a computer to function as each of the sections of the information processing apparatus as set forth in claim 1.

6. A method of controlling an information processing apparatus used in connection with a tape printing apparatus executing steps of:

acquiring from the tape printing apparatus tape information about a tape mounted therein;

discriminating whether a new standardized tape having a standard different from an existing standard is mounted or not based on the tape information;

acquiring a printing parameter corresponding to the new standardized tape in a case that it is discriminated that the new standardized tape is mounted; and transmitting the printing parameter acquired by the printing parameter acquisition step to the tape printing apparatus, wherein the printing parameter includes at least one of print speed of the tape printing apparatus, a number of divisional prints by a print head of the tape printing apparatus in printing, applied time of the print head in the printing, and position information of a heater element formed in the print head used in the printing.

7. The method according to claim 6 further comprising:

reporting that the printing parameter corresponding to the new standardized tape is needed in a case that it is discriminated that the new standardized tape is mounted.

8. The method according to claim 6, wherein the tape information includes at least one of tape width, tape material of the tape and information about ink printed on the tape.

* * * * *